United States Patent [19]

Veeck et al.

[11] 4,104,782

[45] Aug. 8, 1978

[54] METHOD FOR CONSOLIDATING PRECISION SHAPES

[75] Inventors: Stewart J. Veeck; William R. Freeman, both of North Muskegon; Louis E. Dardi, Muskegon, all of Mich.

[73] Assignee: Howmet Turbine Components Corporation, Muskegon, Mich.

[21] Appl. No.: 705,087

[22] Filed: Jul. 14, 1976

[51] Int. Cl.[2] ..... B22D 11/126

[52] U.S. Cl. ..... 29/527.2; 75/226; 75/208 R; 29/420; 264/111

[58] Field of Search ..... 75/223, 226, 214 US, 75/211 US, 224 US, 212 US, 225 US, 208 CS, 226 US; 29/420, 420.5, 527.4, 527.2; 264/111, 121

[56] References Cited

U.S. PATENT DOCUMENTS

| | | | |
|---|---|---|---|
| Re. 28,301 | 1/1975 | Havel | 75/226 |
| 3,455,682 | 7/1969 | Barbaras | 75/226 |
| 3,469,976 | 9/1969 | Iler | 75/223 |
| 3,740,215 | 6/1973 | Burk et al. | 75/214 |

*Primary Examiner*—C.W. Lanham
*Assistant Examiner*—V. K. Rising

[57] ABSTRACT

A method for consolidating powder metal preforms and for thereby producing high performance metal shapes from powder particles. The powder particles are consolidated into a shaped porous preform, and a coating is then applied to the resulting preform. The coating is initially porous whereby the coated preform can be degasified by subjecting the preform to a vacuum, particularly at elevated temperatures. The coated preform is then heated under vacuum to a temperature such that the coating is densified to the extent that it becomes non-porous. The coated preform is then subjected to a hot isostatic pressing operation whereby formation of a high integrity, fully dense metal shape results.

9 Claims, 1 Drawing Figure

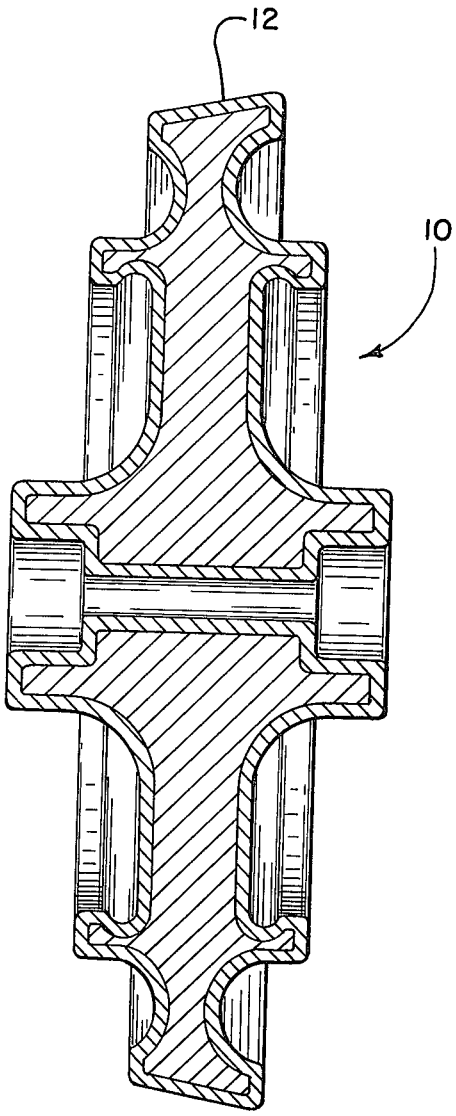
12
10

METHOD FOR CONSOLIDATING PRECISION SHAPES

This invention relates to the production of metal shapes of high integrity whereby superior properties characterize the metal shapes. The invention is particularly concerned with the production of metal shapes utilizing powder metallurgy techniques.

It is well established that powder metallurgy techniques are highly useful for achieving certain advantages in the production of metal shapes. The techniques enable the production of homogeneous metal shapes even where rather complex shapes are involved. In the case of superalloys, for example, uniform and extremely fine grain structure can be attained, and this grain structure is desirable for achieving certain improved mechanical properties. Furthermore, powder particles of superalloy composition can be consolidated and heat treated to achieve comparatively larger grain structure whereby more suitable high temperature performance is rendered possible. These capabilities are achieved along with the more conventional advantages of powder metallurgy. Specifically, this technique enables the attainment of near net shapes (0.1 inch oversize envelopes) which represent cost savings up to about 75 percent over conventional forgings.

One technique available for achieving consolidation of powders is hot isostatic pressing. In such an operation, the powder is located in an autoclave, and heated to a temperature sufficient to achieve densification and particle bonding in response to isostatic pressure. Pressure on the order of 15,000 psi will typically be applied to the powder, and under such conditions, consolidation of the powder particles is achieved with a minimum of internal voids and other defects when compared with casting operations.

One difficulty encountered in the use of hot isostatic pressing involves the need for some means of encapsulating the powder prior to the application of the isostatic pressure. Thus, the powder is porous in nature and in the absence of some encapsulating means, the gas used for applying pressure would penetrate the powder and thereby equalize pressure internally of the preform so that consolidation could not be achieved. Accordingly, the state of the art uses various means such as formed metal, glass, or ceramic containers to provide the necessary encapsulation of the metal powders. However, these methods of powder consolidation are limited in terms of dimensional control and design flexibility of the final desired shape. For example, containment of powders in formed and welded metal cans is limited in design flexibility, particularly where nonreentrant angles are concerned. In addition, weldments often provide significant localized strengthening of the can which can subsequently lead to poor reproducibility of the can movement during hot isostatic processing. Control of shape distortion is also a problem where ceramic molds, loaded with metal powder, are consolidated within metal cans using an intermediate pressure transmitting media. Furthermore, the use of glass containment creates a new set of problems in that the differential thermal expansion between the glass container and metal substrate during heating can result in fracture of the glass container and necessitates specialized handling. Penetration of the glass into the porous metal substrate, insufficient support strength (sagging), and dimensional control are other problems characteristic of glass containment utilization.

It is a general object of this invention to provide an improved arrangement for the formation of metal shapes utilizing powder metallurgy techniques particularly where hot isostatic pressing is used for powder consolidation.

It is a more specific object of this invention to provide an improved method for achieving consolidation of powders utilizing hot isostatic pressing of consolidated metal powder preforms whereby superior consolidated metal shapes are realized using a process which can be practiced on a highly efficient basis.

These and other objects of this invention will appear hereinafter and for purposes of illustration, but not of limitation, the accompanying drawing depicts a metal shape of the type which is involved in the practice of the invention.

The process of the invention generally involves the production of consolidated metal shapes which are originally formed by consolidating metal powders into the desired porous preform shape using any one of many viable methods, including (1) sintering of loose packed powders in suitable shaped reusable or expendable molds; (2) uniaxial or isostatic cold pressing of the loose packed powders in a metal die or rubber molds, respectively; and, (3) spark sintering or the like.

The invention further involves the utilization of hot isostatic pressing techniques whereby the porous powder preform is consolidated to full density by subjecting the preform to high isostatic pressure while maintaining an elevated temperature such that the powder particles will form into a consolidated mass.

The invention more specifically involves the formation of a unique coating on the preform before subjecting the preform to the hot isostatic pressing in an autoclave or similar chamber. The coating initially comprises a porous coating, and the coated preform is subjected to a vacuum while being heated to an elevated temperature whereby it is degasified. The coating is ultimately heated, while the vacuum is being maintained, to a temperature which is sufficient to densify the coating to the extent that it becomes non-porous — e.g., pressure tight. This may involve partial liquation of the coating. The preform thus becomes encapsulated since the coating extends over all surfaces which are to be subjected to the elevated temperature isostatic pressing. When the hot isostatic pressing operation takes place, the pressure applied will then effectively consolidate the particles of the preform. Once the preform has been consolidated in this fashion, the coating is removed whereby the consolidated metal shape can be utilized for the intended purpose.

The accompanying drawing illustrates a cross-sectional view of a turbine disc 10 which can be efficiently produced in accordance with the concepts of this invention.

As is well-known, parts of this type are utilized for aerospace applications and in gas turbines and other applications where strength at extreme temperatures is a critical factor. Moreover, such parts must be produced to near net shape tolerances, in order to achieve effective cost savings over conventional forgings. By utilizing powder metallurgy techniques, such tolerances can be achieved. The process described enables the achievement of such tolerances while producing shapes of an integrity such that superior physical properties are also achieved.

The steps of the invention involve the conventional practice of forming a preform from powder particles, and where turbine discs and other items requiring high temperature performance are involved, superalloy powders can be readily utilized. Pursuant to standard processing, the preform will be consolidated so that the preform will be substantially self-sustaining for handling purposes.

A coating 12 (as shown in the drawing) is applied to the preform, and this coating is preferably formed by applying powder in a thickness between 1 and 10 mils, and preferably between 5 and 10 mils. Coating thicknesses in excess of 10 mils can be used, but at increased processing cost, and thinner coatings also can be used, at reduced reliability of achieving a totally dense layer. Various conventional techniques including flame spraying, plasma spraying, or resin bonding may be employed for achieving this coating. The latter operation involved the utilization of a suspension media which comprises the coating powder and a binder.

By utilizing powder for the formation of the coating, and by utilizing standard coating techniques, the resulting coating must be porous enough to permit degasification of the preform. In the usual practice of the invention, the sintered and coated preform will be heated slowly under a vacuum, and may be held at an intermediate temperature to allow complete degassing of the preform internal pore structure. In the case of a superalloy composition, this intermediate temperature will be in the order of 800° to 1000° F. In those instances where the coating has been applied to the preform with the aid of an organic binder, vacuum decomposition of the binder will be necessary at temperatures in the range of 300°-800° F.

The heating under vacuum is continued to a temperature sufficient to achieve densification of the porous coating. Densification of the coating is preferably achieved by raising the temperature to the extent that a controlled liquid phase develops in the coating. This results in some interdiffusion between the coating and the preform substrate. In the event a braze type alloy coating is used, the process of interdiffusion will result in the formation of alloy constituents of a higher melting point than the liquid phase originally developed in the coating due to alloying of the coating with the substrate. If the coating is a simple binary alloy selected on the basis of having a convenient melting temperature, the melting temperature of the coating may not change due to alloying during the short time the coating alloy is held in the liquid phase region. Such coatings must have several basic characteristics, including the following: (1) the temperature required to achieve complete densification of the coating must not be detrimental to the properties of the substrate, (2) the extent of interdiffusion between the coating and substrate normally should be less than approximately 0.050 inch as a consequence of coating densification and hot isostatic processing consolidation process steps, and (3) the coating must not be liquid at the subsequent hot isostatic process temperatures.

One method of reducing diffusion of the coating into the substrate during formation of the liquid phase during coating densification is to utilize a layered coating such that the desired liquid phase is formed between the separate coating layers away from the immediate surface of the substrate material to be consolidated.

The densification results in a coating which is nonporous. Since the coating is provided all around the preform, this preform will thus be completely encapsulated, and the internal pores will be under vacuum. The preform will, therefore, be in a condition suitable for a hot isostatic pressing operation. Additionally, because of the intimate contact of the then encapsulating coating with the preform substrate and its relatively small section thickness, minimum distortion of the desired shape will occur during hot isostatic processing consolidation of the preform.

The hot isostatic pressing operation involves the introduction of an atmosphere, such as argon gas, and the maintenance of pressure between about 10,000 and 50,000 psi at a temperature sufficient to achieve complete densification of the preform.

In the case of superalloys, a suitable range of temperatures for achieving hot isostatic pressing will be in the range of from 50° F below the gamma prime solvus temperature up to the solidus temperature for the material. Temperatures in the order of 2000° to 2200° F are typical for hot isostatic pressing of superalloys. It is recognized, however, that specialized powder materials sometimes require extended temperature ranges for hot isostatic processing. For example, strain energy processed superalloy powders can be hot isostatic processed as low as 1800° F, which may be over 200° F below the gamma prime solvus.

The known processing temperatures for hot isostatic pressing are preferably utilized when selecting a coating material for a given alloy composition. In view of the techniques described above, it is preferred that the coating material develop a liquid phase at a temperature above the temperature to be employed for hot isostatic pressing. With that relationship of temperatures, the coating can be densified into a non-porous encapsulating coating for purposes of undergoing the hot isostatic pressing.

Other factors will enter into the selection of the coating composition. Naturally compositions which would adversely affect the substrate must be avoided. This includes alloy compositions where gross interdiffusion occurs. In addition, the coating composition must be such that it will retain its integrity under the conditions to which it is subjected. Thus, the coating composition cannot be one that will crack during thermal processing due to the formation of some brittle phase during sintering of the coating. Furthermore, the coating must be such that it will not crack and thereby expose the preform to the high pressure atmosphere due to differential thermal expansion or contraction between the coating and substrate as temperature conditions change. Use of iron base coatings have the additional advantage that the material can be removed selectively after hot isostatic processing using acid solutions which do not adversely affect nickel base substrates.

EXAMPLE I

A sintered Rene' 95 preform was prepared by vacuum sintering −60 mesh Rene' 95 powders in an $Al_2O_3$ mold for 4 hours at 2000° F. The compositional range for the Rene' 95 powder is shown below:

Rene' 95
Chemical Composition, Percent

| | | | |
|---|---|---|---|
| Carbon | 0.04–0.09 | Columbium | 3.30–3.70 |
| Manganese | 0.15 max | Zirconium | 0.03–0.07 |
| Silicon | 0.20 max. | Titanium | 2.30–2.70 |
| Sulfur | 0.015 max | Aluminum | 3.30–3.70 |
| Phosphorus | 0.015 max | Boron | 0.006–0.015 |
| Chromium | 12.00–14.00 | Tungsten | 3.30–3.70 |

-continued

| Rene' 95 Chemical Composition, Percent | | | |
|---|---|---|---|
| Cobalt | 7.00–9.00 | Oxygen | 0.010 max. |
| Molybdenum | 3.30–3.70 | Nitrogen | 0.005 max. |
| Iron | 0.50 max. | Hydrogen | 0.001 max. |
| Tantalum | 0.20 max. | Nickel | Remainder |

The sintered preform was subsequently plasma spray-coated with 0.007 to 0.010 inches of 325/500 mesh fraction of prealloyed Fe-3B powder prepared by gas atomization. It should be noted that mechanical blends of Fe and B could also be used for this purpose.

The plasma spray coating process was performed in air using suitable gun-to-work distances to maintain the substrate temperature below 300° F in order to minimize oxidation of the porous preform and to obtain a permeable coating system (70°–80% T.D.). It is also proposed that plasma coating be performed under inert atmosphere at a somewhat higher processing cost. The plasma coating parameters are summarized below.

| | |
|---|---|
| Gun to work distance | 12 in |
| Primary gas (argon) | 100 CFH |
| Secondary gas (hydrogen) | 15 CFH |
| Voltage | 50 volts |
| Current | 500 amp |
| Carrier gas (argon) | 50 CFH |
| Meter wheel speed | 15 RPM |

The coated preform was subsequently vacuum heat treated to both degas the preform and densify the coating. The heat treat cycle used was as follows:

$$\text{R.T.} \xrightarrow{8^\circ\ F/min} 1000^\circ\ F\ (1\ hr) \xrightarrow{50'\ F/min} 1950^\circ\ F\ (\tfrac{1}{2}\ hr)$$

$$\xrightarrow{50^\circ\ F/min} 2150^\circ\ F\ (\tfrac{1}{3}\ hr) \xrightarrow{\text{Furnace Cool}} 1950^\circ\ F\ (\tfrac{1}{2}\ hr)$$

$$\xrightarrow{\text{Gas Fan Cool}} \text{R.T.}$$

It should be noted that the holding times at the 1000° F degas temperature will be dependent upon the section size of the preform. The Fe-3B binary alloy has a eutectic melting temperature of 2100° F, and the selected densification temperature of 2150° F will result in approximately 85 percent liquid under equilibrium thermal conditions. The time at peak temperature must be limited to minimize the depth of the diffusion zone in the substrate.

Hot isostatic pressing of the coated preform was performed at 2050° F for 4 hours, at 15 ksi. The hot isostatic process cycle utilized a partial elevation of temperature under moderate pressure (<1 ksi) with full application of pressure (15 ksi) being applied above 1700° F. This allows the coating to be fully plastic prior to the application of full pressure and minimizes the potential for distortion or cracking of the coating. Subsequent examination of hot isostatic consolidated material revealed an interdiffusion zone between the coating and substrate of about 0.05 to 0.06 inches. The coating was removed through the use of chemical etching methods.

Room temperature tensile property evaluations of a specimen consolidated in the above manner and subsequently heat treated yielded in the following data:

| UTS, ksi | YS, ksi | Elong, % | RA, % |
|---|---|---|---|
| 230 | 184 | 15 | 14 |

EXAMPLE II

A blended slurry of −500 mesh gas atomized Fe-3B powder and Acryloid resin, grade B-7*, was prepared and thinned to a suitable viscosity using an acetone additive. The slurry consisted of about 20–40 vol % Fe-3B powder, 30–40 vol % Acryloid resin, and 30–40 % acetone. A sintered preform was mechanically attached to a superalloy support rod and subsequently dipped into the slurry. The excess slurry was allowed to drain down the support rod and the coated preform was allowed to air cure a minimum of 8 hours prior to dip coating and curing a second time under identical conditions. A total minimum coating thickness of 0.01–0.02 inches was applied in this manner. The coated preform, with the support rod still attached was then vacuum sintered to densify the coating using the same vacuum heating cycle as described in Example I; however, in this instance, since a resin binder was used to apply the coating, an additional intermediate temperature hold at 600° F (2 hrs) was utilized to accommodate decomposition of the resin binder.

*Rohm and Haas

EXAMPLE III

A sintered Rene' 95 preform was plasma spray coated with 914E braze alloy** produced by inert gas atomization. A 200/270 mesh powder fraction was used for coating and plasma spray coating parameters were identical to those used in Example I. The composition of the 914E Braze alloy is shown below:

**Alloy Metals, Inc.

| B | C | Co | Si | Ta | Rare Earth | Ni |
|---|---|---|---|---|---|---|
| 1.79 | 0.012 | 20.40 | 3.68 | 2.96 | 0.041 | bal |

The final coating thickness was in the range of 0.006 to 0.007 inches. The coated preform was then vacuum heat treated using the following cycle:

$$\text{R.T.} \xrightarrow{50^\circ\ F/min} 1950^\circ\ F\ (\tfrac{1}{4}\ hr) \xrightarrow{50^\circ\ F/min} 2075^\circ\ F\ (\tfrac{1}{2}\ hr)$$

$$\xrightarrow{\text{Furnace Cool}} 1950^\circ\ F\ (\tfrac{1}{4}\ hr) \xrightarrow{\text{Gas Fan Cool}} \text{R.T.}$$

The specific advantage of using the braze alloy composition is that it allows a reduced coating densification temperature to be used in comparison to the Fe-3B coating system. However, coating removal by selective etching techniques after hot isostatic processing are not practical and the preferred method of removing the coating in this instance is through controlled non-selective etching or machining. However, due to high hardness, machining of braze coatings by conventional methods can be difficult.

The time and temperature figures given may vary since, for example, degassing could take place at higher or lower temperatures, and the temperature employed would affect the time of holding. Different times and temperatures can also be selected based on factors such as the degree of compacting of the preform and porosity of the coating. The most efficient degassing operation for a given substrate and coating can be readily determined by simple testing.

It will also be appreciated that the temperatures employed for vacuum sintering of the coating to insure encapsulation can be readily determined. In this connection, the utilization of elemental constituents, such as boron, carbon or silicon, in the coating compositions is desirable since these materials will act as melting point depressants which will form a liquid phase which will ultimately disappear as interdiffusion progresses.

It will be appreciated that information is available to those skilled in the art regarding phase transformation in alloy system, and that such information can be readily utilized for purposes of selecting coating compositions for substrates in order to practice the concepts of this invention.

Various other changes and modifications may be made in the practice of the invention without departing from the spirit of the invention particularly as defined in the following claims.

We claim:

1. In a process for producing metal shapes from powder particles wherein the particles are shaped into a self-sustaining porous preform which is subjected to a hot isostatic pressing operation consisting of locating the preform in a chamber having a surrounding gaseous atmosphere and heating the preform in said chamber to an elevated temperature while isostatic pressure is being applied, said temperature being sufficient to densify said preform and consolidate said particles through bonding thereof, the improvement comprising the steps of forming an all-encompassing porous coating on the preform prior to hot isostatic pressing, subjecting the coated preform to a vacuum whereby the preform is degasified, heating the coated preform, while maintaining the vacuum, to a temperature sufficient to fully density said coating so that the coating becomes non-porous and pressure-tight, and thereafter subjecting said preform to said hot isostatic pressing, said coating being solid during said hot isostatic pressing.

2. A process in accordance with claim 1 including the step of sintering said preform in an inert ceramic mold prior to coating.

3. A process in accordance with claim 1 wherein said preform is heated to a temperature for densifying said coating which is in excess of the temperature prevailing in said chamber during application of said isostatic pressure.

4. A process in accordance with claim 3 wherein said preform is degasified at an elevated temperature below the temperature at which said isostatic pressure is applied.

5. A process in accordance with claim 1 wherein said coating is formed by applying a layer of powder in a thickness in excess of 5 mils to said preform.

6. A process in accordance with claim 5 wherein said powder is applied by one of the methods selected from the group consisting of flame spraying, plasma spraying and resin bonding.

7. A process in accordance with claim 1 including the step of removing said coating subsequent to removal of the metal shape from said chamber.

8. A process in accordance with claim 1 wherein said coating includes material forming a liquid phase in the coating when heated to said temperature which is sufficient to densify said coating and result in a gas impermeable coating completely surrounding the preform.

9. A process in accordance with claim 8 wherein said preform is heated to a temperature for densifying said coating which is in excess of the temperature prevailing in said chamber during application of said isostatic pressure, said process including cooling said preform to the hot isostatic pressing temperature after densification of said coating.

* * * * *